United States Patent [19]

Nidola et al.

[11] Patent Number: 4,975,161

[45] **Date of Patent: * Dec. 4, 1990**

[54] ELECTRODES FOR USE IN ELECTROCHEMICAL PROCESSES AND METHOD FOR PREPARING THE SAME

[75] Inventors: Antonio Nidola; Renato Schira, both of Milan, Italy

[73] Assignee: De Nora Permelec S.p.A., Italy

[ * ] Notice: The portion of the term of this patent subsequent to Feb. 9, 2005 has been disclaimed.

[21] Appl. No.: 930,173

[22] PCT Filed: Apr. 11, 1986

[86] PCT No.: PCT/EP86/00213

§ 371 Date: Oct. 30, 1986

§ 102(e) Date: Oct. 30, 1986

[87] PCT Pub. No.: WO86/06108

PCT Pub. Date: Oct. 23, 1986

[30] Foreign Application Priority Data

Apr. 12, 1985 [IT] Italy ..... 2039 A/85
Feb. 21, 1986 [IT] Italy ..... 19504 A/86

[51] Int. Cl.[5] ..... C25B 1/16

[52] U.S. Cl. ..... 204/98; 204/128; 204/129; 204/252; 204/290 R; 204/291

[58] Field of Search ..... 204/290 F, 290 R, 98, 204/128-129, 252, 291-292

[56] References Cited

U.S. PATENT DOCUMENTS

| | | | |
|---|---|---|---|
| 3,788,968 | 1/1974 | Müller et al. | 204/290 R |
| 3,990,957 | 11/1976 | Hoekje et al. | 204/128 |
| 4,072,505 | 2/1978 | Bianchi et al. | 204/98 |
| 4,100,049 | 7/1978 | Brannan | 204/290 R |
| 4,465,580 | 8/1984 | Kasuya | 204/290 F |
| 4,515,673 | 5/1985 | Hayfield | 204/290 F |
| 4,528,084 | 7/1985 | Beer et al. | 204/290 F |
| 4,724,052 | 2/1988 | Nidola | 204/98 |

FOREIGN PATENT DOCUMENTS

| | | |
|---|---|---|
| 0014596 | 8/1980 | European Pat. Off. . |
| 0126189 | 11/1984 | European Pat. Off. . |
| 0129734 | 1/1985 | European Pat. Off. . |
| 57-207183 | 12/1982 | Japan . |
| 60-17085 | 1/1985 | Japan . |
| 1553367 | 9/1979 | United Kingdom . |

*Primary Examiner*—John F. Niebling
*Assistant Examiner*—Kathryn Gorgos
*Attorney, Agent, or Firm*—Pollock, Vande Sande & Priddy

[57] ABSTRACT

The present invention concerns electrodes for use in electrochemical processes, particularly as cathodes for hydrogen evolution in cells for the electrolysis of alkali metal halides, the electrodes comprising an electrocatalytic ceramic coating obtained by thermal deposition. Elements of the groups IB, IIB, IIIA, IVA, VA, V B; VI A; VI B and VIII are added to the solutions or dispersion of precursor compounds of electrocatalytic ceramic materials, the solutions or dispersions being thermally decomposed to obtain the coating.

The surface of the doped coating thus obtained is substantially immune to poisoning by metal impurities, when the electrode according to the present invention is used as cathode in poisoned alkali solutions.

7 Claims, No Drawings

ELECTRODES FOR USE IN ELECTROCHEMICAL PROCESSES AND METHOD FOR PREPARING THE SAME

FIELD OF THE INVENTION

The present invention relates to electrodes provided with an electrocatalytic ceramic coating applied by thermal depostion. Said electrodes are suitable for use in electrochemical processes and in particular as cathodes for hydrogen evolution in cells for the electrolysis of alkali metal halides.

The invention further concerns the process for preparing said electrodes

BACKGROUND ART

The technological advance in the field of alkali halides electrolysis has brought to an ever diminishing consumption of energy per unity of product. This result is due to the remarkable improvement of the cell geometry design (see for example Italian Application No. 19502 A/80 by the same applicant, as a consequence of both the advent of ion exchange membranes instead of porous diaphragms (see for example British Patent Publication No. 2 064 586 A) and the use of cathodes exhibiting an ever increasing electrocatalytic activity, that is a lower hydrogen overvoltage.

Such cathodes are obtained by applying a ceramic catalytic coating onto a supporting metal substrate, having suitable geometry (for example expanded sheet) and made of a conductive metal, such as nickel, copper and alloys thereof. The ceramic electrocatalytic coating may be directly applied onto the supporting metal substrate by thermal decomposition of liquids containing precursor compounds of the ceramic electrocatalytic materials, either in solution or as dispersions ("paints").

A serious drawback affecting the cathodes thus obtained is represented by the poor adhesion of the coating to the supporting metal substrate due to the substantial structural incompatibility between the oxides film normally formed onto the substrate surface and the ceramic electrocatalytic material of the coating.

Various attempts to solve the above problem have been undertaken. In one case, for example, the coating is applied in repeated layers which have a varying composition, the inner layer being substantially compatible with the supporting metal substrate, and the external one exhibiting a higher electrocatalytic activity (see for example European Patent Publication No. 0129088 A1).

An efficient alternative is represented by a metal interlayer containing ceramic material particles which are isomorphous with the ceramic electrocatalytic material to be thermally deposited, said interlayer being interposed between the substrate and the external coating, at least onto a portion of the metal substrate surface.

Onto said interlayer, having a suitable thickness, a paint is applied, which is constituted by a solution or dispersion of precursor compounds of the ceramic electrocatalytic coating. After removal of the solvent, heating in an oven is carried out at a temperature and for a time sufficient to transform these precursor compounds into the desired ceramic electrocatalytic material. The desired thickness is obtained by repeating the process for the sufficient number of times.

The electrodes thus obtained are used as cathodes for the electrolysis of alkali halides and more particularly for the electrolysis of sodium chloride and to allow for an active lifetime three to eight times longer than conventional cathodes obtained by thermal deposition according to the prior art (see Italian patent Application No. 83633 A/84).

These electrodes further provide for a low overvoltage and a better resistance to poisoning due to heavy metals, such as iron and mercury present in the electrolyte, compared with conventional cathodes, for example cathodes provided with a galvanically deposited, pigmented electrocatalytic coating (see Belgian Pat. No. 848,458 and U.S. Pat. No. 4,465,580).

It is well-known that, in the specific case of brine electrolysis, the impurities more frequently encountered are iron and mercury: iron may come from the use of potassium ferrocyanide as anticaking agent or from corrosion of the ferrous structures of the cathodic compartment or fittings thereof, while mercury is usually present in the brine circuit when the mercury cells are converted to membrane cells.

As soon as these impurities, usually present in the solution under ionic complex form, diffuse to the cathodic surface, they are readily electroprecipitated to their metallic state, thus neutralizing the catalyst active sites.

Catalytic aging, which may depend on various factors such as the type of cathodic material (composition and structure), operating conditions (temperature, catholyte concentration) and the nature of the impurity, may occur remarkably and irreversibly soon after a few hours of operation.

However, the problems affecting durability and efficiency, which involve consequently resistance of the coated surface to poisoning due to metal impurities, are not yet satisfactorily overcome, taking into account the long-term performance required for an industrially efficient cathode.

In fact, while iron concentrations up to 50 ppm do not seem to negatively affect the cathodes potentials of electrodes provided with thermoformed electrocatalytic ceramic material, higher concentrations, up to 100 ppm, being necessary to observe a poisoning effect, in the case of mercury the cathode potential results remarkably increased soon after short periods of time, in the presence of 3–10 ppm of Hg ions.

SUMMARY OF THE INVENTION

It is an object of the present invention to provide for electrodes having an electrocatalytic ceramic coating applied by thermal depostion, which is substantially immune to poisoning due to the above mentioned impurities.

It has been surprisingly found that electrodes which are substantially immune to poisoning by heavy metals are obtained by adding dopants to the electrocatalytic ceramic coating. Said dopants are constituted by elements of the groups IB, IIB, IIIA, IVA, VA, VB, VIA, VIB and VIII of the Periodic Table.

DESCRIPTION OF PREFERRED AND VARIOUS EMBODIMENTS

More particularly, an electrode according to the present invention, for use in electrochemical processes, comprises a current conductive metal substrate and an external coating substantially constituted by electrocatalytic ceramic material and is characterized in that said electrocatalytic ceramic material is doped by the elements of the aforementioned groups of the Periodic Table.

The electrode of the present invention is also characterized in that the metal substrate is constituted by one of the metals belonging to the group comprising iron, chromium, stainless steel, cobalt, nickel, copper, silver, and alloys thereof. Particularly, the electrode is characterized in that the doping element of group IB is copper, silver or gold; the doping element of group IIB is cadmium; the doping element of group IIIA is thallium; the doping element of group IVA is lead or tin; the doping element of group VA is arsenic, antimony or bismuth; the doping element of group VB is vanadium; the doping element of group VIA is selenium or tellurium; the doping element of group VIB is molybdenum or tungsten; the doping element of group VIII is platinum or palladium.

Moreover, the electrode according to the present invention is characterized in that between the electrically conductive metal substrate and the electrocatalytic ceramic coating an interlayer is interposed at least onto a portion of the metal substrate surface, said interlayer being substantially constituted by a metal matrix containing, dispersed therein, ceramic particles substantially isomorphous with the electrocatalytic ceramic coating. Particularly, the electrode is characterized in that the metal matrix of the interlayer is constituted by a metal belonging to the group comprising iron, nickel, chromium, copper, cobalt, silver, and alloys thereof; and more particularly in that the ceramic material isomorphous particles are constituted by oxides or mixed oxides of titanium, tantalum, ruthenium, iridium, and mixtures thereof.

The method for preparing an electrode according to the present invention comprises:

(a) applying onto the surface of the substrate a solution or dispersion of precursor compounds of the electrocatalytic ceramic material selected for forming the electrocatalytic superficial coating;

(b) removing the solvent of said solution or dispersion of precursor compounds;

(c) heating in an oven at a temperature and for a time sufficient to convert said precursor compound into ceramic material;

(d) cooling down to room temperature;

(e) optionally, repeating steps (a), (b), (c) and (d) as many times as necessary to obtain the desired thickness of the electrocatalytic superficial coating;

is characterized in that the solution or dispersion of step (a) further contains compounds of elements of the groups IB, IIB, IIIA, IVA, VA, VB, VIA, VIB and VIII of the Periodic Table.

Particularly, the method is characterized in that it comprises, before step (a), a further step consisting in forming on at least a portion of the metal substrate surface, an interlayer constituted by a metal matrix containing, dispersed therein, ceramic material particles substantially isomorphous with the external electrocatalytic ceramic coating, by galvanic electrodeposition from a galvanic plating bath containing ions of the matrix metal and, held in suspension, the isomorphous ceramic particles, for a time sufficient to obtain the desired thickness of the interlayer.

The paint is constituted by a solution or dispersion in a suitable solvent of precursor compounds of the desired electrocatalytic ceramic material.

The precursor compounds are converted into the desired final compound by heating in an oven, generally at a temperature in the range of 300° C. to 650° C., after controlled evaporation of the solvent.

In the case the electrocatalytic ceramic material is an oxide or a mixed oxide, heating in oven is carried out in the presence of oxygen.

The precursor compounds may be inorganic salts of the metal or metals constituting the electrocatalytic ceramic material, such as chlorides, nitrates, sulphates or organic compounds of the same metals, such as resinates, alcoholates and the like.

The paint further contains compounds, such as salts or oxides, of the doping elements in suitable concentrations, as illustrated in the following examples.

The method of the present invention is also characterized in that the metal substrate is subjected to a preliminary treatment consisting of degreasing, followed by sand-blasting and/or acid pickling.

The electrocatalytic ceramic coating obtained by thermal decomposition of a suitable paint for as many applications as to form the desired thickness, is preferably constituted by compounds (such as oxides, mixed oxides, sulphides, borides, carbides, nitrides) of at least a metal belonging to the group comprising ruthenium, iridium, platinum, rhodium, palladium. Further, the same compounds of different metals such as titanium, tantalum, niobium, zirconium, hafnium, nickel, cobalt, tin, manganese, and yttrium may be added. The doping elements result in any case uniformly dispersed in the electrocatalytic ceramic material.

The concentration of the dopants contained in the paint falls within the following ranges:

elements belonging to the groups IB and VIII: 0.05–1 ppm (as metal)

elements belonging to the groups IIB, III A, IVA and V A: 1–10,000 ppm (as metal)

elements belonging to the groups VB, VIA, VIB: 30–1,000 ppm (as metal)

The quantity of electrocatalytic ceramic material is generally comprised between 2 and 20 grams/square meter, depending on the selected composition and the desired electrochemical activity. No appreciable improvement, either as regards overvoltage as well as operating lifetime, is observed by increasing the above quantities.

The following examples are reported in order to illustrate the invention in greater detail. As regards the dopants concentrations, only the results obtained with the optimized quantity of dopant are reported, that is the smallest quantities which allow obtaining electrodes characterized by the lowest overvoltages and concurrently the longest active lifetime.

However, it has been found that the dopants concentration range allowing for significant improvement of the resistance to poisoning due to heavy metals, is rather ample, as previously illustrated.

It is therefore to be intended that the invention is not limited to the specific examples reported hereinbelow. Furthermore, it should be understood that the electrodes of the present invention may be advantageously utilized as cathodes for an electrochemical process different from alkali halides electrolysis, such as for example alkaline water electrolysis, or electrolysis processes for producing chlorates and perchlorates.

EXAMPLE 1

Nickel expanded sheet samples (10×20 mm, thickness 0.5 mm, diameter diagonals 2×4 mm) were sandblasted and pickled in a 15 percent nitric acid solution for about 60 seconds. The samples were then activated by an electrocatalytic ceramic oxides coating obtained by thermal decomposition in an oven, utilizing a paint having the following composition:

| | |
|---|---|
| ruthenium chloride | 26 g as metal |
| zirconium chloride | 8 g as metal |
| aqueous solution of isopropylic alcohol | 150 ml |
| water | up to a volume 1000 ml |

Salts of the elements belonging to the groups IB and VIII were added to the paint in a quantity of 0.1 ppm as metal.

After drying at 60° C. for ten minutes, the samples were heated in an oven at 500° C. for ten minutes and then allowed to cool down to room temperature.

The above cycle: painting-drying-decomposition - was repeated as many times as to obtain an oxide coating containing 10 grams per square meter, determined by x-ray fluorescence.

The samples thus activated were tested as cathodes, under a current density of 3 kA/square meter, at 90° C., in 33% NaOH solutions, either unpoisoned and poisoned by mercury (10 ppm as metal).

The cathodic potentials, detected versus a mercury oxide (HgO/Hg) reference electrode, are reported in table I, as a function of the electrolysis time.

TABLE 1

Cathodic Potential as a function of the electrolysis time

| Dopant added to the paint | | Cathodic Potential V (HgO/Hg) | | | Impurity contained in NaOH | |
|---|---|---|---|---|---|---|
| Salt | ppm (as metal) | Initial | 1 day | 10 days | type | ppm (as metal) |
| nil | — | −1.01 | −1.01 | −1.01 | — | — |
| nil | — | −1.01 | −1.02 | −1.18 | Hg | 10 |
| PtC14 | 0.1 | −1.04 | −1.04 | −1.08 | Hg | 10 |
| PdC12 | 0.1 | −1.04 | −1.05 | −1.10 | Hg | 10 |
| CuC12 | 0.1 | −1.04 | −1.06 | −1.11 | Hg | 10 |
| Ag(NH3)2Cl | 0.1 | −1.04 | −1.06 | −1.11 | Hg | 10 |
| AuC13 | 0.1 | −1.05 | −1.06 | −1.09 | Hg | 10 |

EXAMPLE 2

Various mesh samples (25 mesh) made of nickel wire having a diameter of 0.1 mm, were steam-degreased and subsequently pickled in 15% nitric acid for 60 seconds.

The nickel meshes, utilized as substrates, were coated by electrodeposition

| | |
|---|---|
| nickel sulphate (NiSO4.7H2O) | 210 g/l |
| nickel chloride (NiC12.6H2O) | 60 g/l |
| boric acid | 30 g/l |
| ruthenium oxide | 40 g/l |
| The operating conditions were as follows: | |
| temperature | 50° C. |
| cathodic current density | 100 A/square meter |
| RuO2 particles diameter: | |
| average | 2 micrometers |
| minimum | 0.5 micrometers |
| maximum | 5 micrometers |
| stirring | mechanical |
| electrodeposition time | 2 hours |
| coating thickness | about 30 micrometer |
| coating composition | 10% dispersed RuO2 90% Ni |
| coating surface morphology | dendritic |

After rinsing in dionized water and drying, an aqueous paint was applied onto the various samples thus obtained, said paint having the following composition:

| | |
|---|---|
| ruthenium chloride | 10 g as metal |
| titanium chloride | 1 g as metal |
| aqueous solution of 30% hydrogen peroxide | 50 ml |
| aqueous solution of 20% hydrochloric acid | 150 ml |
| water | up to a volume of 1,000 ml |

Cadmium chloride was added to the paints, in a quantity varying from 1 to 1,000 ppm (as metal).

After drying at 60° C. for about 10 minutes, the samples were heated in an oven at 480° C. for 10 minutes in the presence of air and then allowed to cool down to room temperature.

Under a scanning electron microscope, a superficial oxide coating appeared to have formed, which, upon X-ray diffraction, was found to be a solid solution of ruthenium and titanium oxide.

The superficial oxide coating thickness was about 2 micrometers and the quantity, determined by weighing, was about 4 grams per square meter.

The samples thus obtained were tested as cathodes in a 33% NaOH alkali solution, at 90° C. and 3 kA/square meter and, under the same operating conditions, in similar solutions containing 50 ppm of mercury.

The following table 2 shows the electrode potentials detected at different times for the cathode samples free from dopants and for the cathode samples whereto paint containing 1, 10 and 1,000 ppm of a cadmium were applied.

TABLE 2

Cathodic Potential as a function of the electrolysis time

| Dopant added to the paint | | Cathodic Potential V (HgO/Hg) | | | Impurity contained in NaOH | |
|---|---|---|---|---|---|---|
| Salt | ppm (as metal | Initial | 1 hour | 24 hours | type | ppm (as metal) |
| nil | — | −1.05 | −1.07 | −1.63 | Hg | 50 |
| CdC12 | 1 | −1.05 | −1.06 | −1.18 | Hg | 50 |
| CdC12 | 10 | −1.04 | −1.04 | −1.12 | Hg | 50 |
| CdC12 | 1,000 | −1.05 | −1.05 | −1.08 | Hg | 50 |

EXAMPLE 3

Various mesh samples (25 mesh) made of nickel wire having a diameter of 0.1 mm, were steam-degreased and subsequently pickled in 15% nitric acid for 60 seconds.

The nickel meshes, utilized as substrates, were coated by electrodeposition from a galvanic bath having the following composition:

| | |
|---|---|
| nickel sulphate (NiSO4.7H2O) | 210 g/l |
| nickel chloride (NiC12.6H2O) | 60 g/l |
| boric acid | 30 g/l |
| ruthenium oxide | 40 g/l |
| The operating conditions were as follows: | |
| temperature | 50° C. |
| cathodic current density | 100 A/square meter |
| RuO2 particles diameter: | |
| average | 2 micromeers |
| minimum | 0.5 micrometers |
| maximum | 5 micrometers |
| stirring | mechanical |
| electrodeposition time | 2 hours |
| coating thickness | about 30 micrometer |

-continued

| | |
|---|---|
| coating composition | 10% dispersed RuO2<br>90% Ni |
| coating surface morphlogy | dendritic |

After rinsing in dionized water and drying, an aqueous paint was applied onto the various samples thus obtained, said paint having the following composition:

| | |
|---|---|
| ruthenium chloride | 26 g as metal |
| zirconium chloride | 8 g as metal |
| aqueous solution of 20% hydrochloric acid | 305 ml |
| isopropylic alcohol | 150 ml |
| water | up to a volume 1000 ml |

A quantity of 10 ppm as $CdCl_2$ was added to the paint.

The samples thus obtained were tested as cathodes in a 33% NaOH alkali solutions, at 90° C. and 3 kA/square meter and, under the same conditions, in similar solutions poisoned by Fe (50 ppm) and Hg (10 ppm), together with non-doped cathodes for comparison purpose.

The electrodes actual potentials versus time of operation is reported in Table 3.

TABLE 3

| Cathodic Potential as a function of the electrolysis time | | | | | | |
|---|---|---|---|---|---|---|
| Dopant added to the paint | | Cathodic potential V (HgO/Hg) | | | Impurity contained in NaOH | |
| Salt | ppm (as metal) | Initial | 1 day | 10 days | type | ppm (as metal) |
| nil | — | −1.04 | −1.04 | −1.04 | — | — |
| nil | — | −1.04 | −1.10 | −1.18 | Hg | 10 |
| nil | — | −1.04 | −1.04 | −1.04 | Fe | 50 |
| CdC12 | 10 | −1.04 | −1.04 | −1.04 | — | — |
| CdC12 | 10 | −1.04 | −1.04 | −1.04 | Hg | 10 |
| CdC12 | 10 | −1.04 | −1.04 | −1.04 | Fe | 50 |

EXAMPLE 4

Nickel expanded sheet samples (10×20 mm) were prepared as illustrated in Example 1.

The paint was also added with 500 ppm of $CdCl_2$ (as metal).

After drying at 60° C. for ten minutes, the samples were treated in an oven at 500° C. for 10 minutes and cooled down. The procedure painting-drying-decomposition was repeated until an oxide coating containing a quantity of ruthenium of 10 grams per square meter was obtained, as detected by X-ray fluorescence.

The samples thus activated were tested as cathodes at 90° C., under a current density of 3 kA/square meter in 33% NaOH solutions either un-poisoned or poisoned by mercury (10 and 50 ppm) and iron (50 and 100 ppm). The results are illustrated in Table 4.

TABLE 4

| Cathodic Potential as a function of the electrolysis time | | | | | | |
|---|---|---|---|---|---|---|
| Dopant added to the paint | | Cathodic Potential V (HgO/Hg) | | | Impurity contained in NaOH | |
| Salt | ppm (as metal) | Initial | 1 day | 10 days | type | ppm (as metal) |
| nil | — | −1.01 | −1.01 | −1.01 | — | — |
| nil | — | −1.01 | −1.02 | −1.18 | Hg | 10 |
| nil | — | −1.05 | −1.70 | −2.10 | Hg | 50 |
| nil | — | −1.01 | −1.02 | −1.03 | Fe | 50 |
| nil | — | −1.02 | −1.07 | −1.09 | Fe | 100 |

TABLE 4-continued

| Cathodic Potential as a function of the electrolysis time | | | | | | |
|---|---|---|---|---|---|---|
| Dopant added to the paint | | Cathodic Potential V (HgO/Hg) | | | Impurity contained in NaOH | |
| Salt | ppm (as metal) | Initial | 1 day | 10 days | type | ppm (as metal) |
| $CdC1_2$ | 500 | −1.02 | −1.02 | −1.02 | — | — |
| $CdCl_2$ | 500 | −1.04 | −1.06 | −1.08 | Hg | 50 |
| $CdCl_2$ | 500 | −1.04 | −1.04 | −1.04 | Fe | 100 |

EXAMPLE 5

Various mesh samples (25 mesh) made of nickel wire having a diameter of 0.1 were prepared as illustrated in Example 2.

Quantities determined case by case of $TlCl_3$ or $Pb(NO_3)_2$, $SnCl_2$, $As_2O_3$, SbOCl, BiOCl in a concentration of 1–10–1000 ppm as metal, were added to the paint.

After drying at 60° C. for 10 minutes, the samples were treated in an oven at 480° C. in the presence of air for 10 minutes and allowed to cool down to room temperature.

Under microscopic scanning, a superficial oxide coating was observed, which under X-ray diffraction was determined to be formed by $RuO_2$ and $TiO_2$.

The thickness of the oxide coating was about 2 micrometers and the quantity, determined by weighing, was about 4 g/square meter.

The samples thus obtained were tested as cathodes in a 33% NaOH solution, at 90° C. and 3 kA/square meter and, under the same conditions, in similar solutions containing 50 ppm of mercury.

The following Table 5 shows the actual electrode potentials detected at different operating times for each case.

TABLE 5

| Cathodic Potential as a function of the electrolysis time | | | | | | |
|---|---|---|---|---|---|---|
| Dopant added to the paint | | Cathodic potential V (HgO/Hg) | | | Impurity contained in NaOH | |
| Salt | ppm (as metal) | Initial | 1 hour | 24 hours | type | ppm (as metal) |
| nil | — | −1.05 | −1.07 | −1.63 | Hg | 50 |
| $TlCl_3$ | 1 | −1.05 | −1.08 | −1.28 | Hg | 50 |
| $TlCl_3$ | 10 | −1.05 | −1.05 | −1.17 | Hg | 50 |
| $TlCl_3$ | 1,000 | −1.04 | −1.04 | −1.15 | Hg | 50 |
| Pb(NO3)2 | 1 | −1.04 | −1.06 | −1.17 | Hg | 50 |
| Pb(NO3)2 | 10 | −1.04 | −1.05 | −1.11 | Hg | 50 |
| Pb(NO3)2 | 1,000 | −1.04 | −1.05 | −1.14 | Hg | 50 |
| $SnCl_2$ | 1 | −1.04 | −1.09 | −1.32 | Hg | 50 |
| $SnCl_2$ | 10 | −1.05 | −1.06 | −1.21 | Hg | 50 |
| $SnCl_2$ | 1,000 | −1.05 | −1.06 | −1.25 | Hg | 50 |
| $As_2O_3$ | 1 | −1.04 | −1.08 | −1.19 | Hg | 50 |
| $As_2O_3$ | 10 | −1.04 | −1.04 | −1.10 | Hg | 50 |
| $As_2O_3$ | 1,000 | −1.05 | −1.05 | −1.12 | Hg | 50 |
| SbOCl | 1 | −1.04 | −1.09 | −1.27 | Hg | 50 |
| SbOCl | 10 | −1.04 | −1.05 | −1.15 | Hg | 50 |
| SbOCl | 1,000 | −1.05 | −1.05 | −1.13 | Hg | 50 |
| BiOCl | 1 | −1.04 | −1.06 | −1.26 | Hg | 50 |
| BiOCl | 10 | −1.04 | −1.04 | −1.12 | Hg | 50 |
| BiOCl | 1,000 | −1.05 | −1.05 | −1.09 | Hg | 50 |

EXAMPLE 6

Various mesh samples (25 mesh) made of nickel wire having a diameter of 0.1 mm, were prepared as illustrated in Example 3.

Quantities determined case by case of $CdCl_2$ or $TlCl_3$, $Pb(NO_3)_2$, $SnCl_2$, $As_2O_3$, SbOCl, BiOCl in a concentration of 10 ppm as metal, were added to the solution.

After drying at 60° C. for 10 minutes, the samples were treated in an oven at 480° C. in the presence of air for 10 minutes and allowed to cool down to room temperature.

The samples thus obtained were tested as cathodes in a 33% NaOH solution, at 90° C. and 3 kA/square meter and, under the same conditions, in similar solutions containing 10, 20, 30, 40 and 50 ppm of mercury and compared with equivalent non-doped cathodes.

The following Table 6 shows the actual electrode potentials detected at different operating time for each case.

TABLE 6

Cathodic Potential as a function of the electrolysis time

| Dopant added to the paint | | Cathodic potential V (HgO/Hg) | | | Impurity contained in NaOH | |
|---|---|---|---|---|---|---|
| Salt | ppm (as metal) | Initial | 1 day | 10 days | type | ppm (as metal) |
| nil | — | −1.04 | −1.04 | −1.04 | Hg | 0 |
| nil | — | −1.04 | −1.10 | −1.18 | Hg | 10 |
| nil | — | −1.05 | −1.22 | −1.39 | Hg | 20 |
| nil | — | −1.04 | −1.47 | −1.71 | Hg | 30 |
| nil | — | −1.05 | −1.55 | −2.10 | Hg | 40 |
| nil | — | −1.05 | −1.70 | −2.10 | Hg | 50 |
| $CdCl_2$ | 10 | −1.04 | −1.04 | −1.04 | Hg | 10 |
| $CdCl_2$ | 10 | −1.04 | −1.04 | −1.08 | Hg | 20 |
| $CdCl_2$ | 10 | −1.05 | −1.06 | −1.12 | Hg | 30 |
| $CdCl_2$ | 10 | −1.05 | −1.09 | −1.15 | Hg | 40 |
| $CdCl_2$ | 10 | −1.04 | −1.12 | −1.30 | Hg | 50 |
| $TlCl_3$ | 10 | −1.05 | −1.05 | −1.05 | Hg | 10 |
| $TlCl_3$ | 10 | −1.05 | −1.05 | −1.07 | Hg | 20 |
| $TlCl_3$ | 10 | −1.05 | −1.07 | −1.13 | Hg | 30 |
| $TlCl_3$ | 10 | −1.05 | −1.10 | −1.16 | Hg | 40 |
| $TlCl_3$ | 10 | −1.04 | −1.17 | −1.32 | Hg | 50 |
| $Pb(NO_3)_2$ | 10 | −1.04 | −1.04 | −1.04 | Hg | 10 |
| $Pb(NO_3)_2$ | 10 | −1.04 | −1.04 | −1.04 | Hg | 20 |
| $Pb(NO_3)_2$ | 10 | −1.04 | −1.04 | −1.09 | Hg | 30 |
| $Pb(NO_3)_2$ | 10 | −1.05 | −1.12 | −1.25 | Hg | 50 |
| $SnCl_2$ | 10 | −1.04 | −1.04 | −1.04 | Hg | 10 |
| $SnCl_2$ | 10 | −1.04 | −1.04 | −1.04 | Hg | 20 |
| $SnCl_2$ | 10 | −1.04 | −1.04 | −1.08 | Hg | 30 |
| $SnCl_2$ | 10 | −1.04 | −1.09 | −1.14 | Hg | 40 |
| $SnCl_2$ | 10 | −1.05 | −1.18 | −1.24 | Hg | 50 |
| $As_2O_3$ | 10 | −1.04 | −1.04 | −1.04 | Hg | 10 |
| $As_2O_3$ | 10 | −1.04 | −1.04 | −1.04 | Hg | 20 |
| $As_2O_3$ | 10 | −1.05 | −1.07 | −1.11 | Hg | 30 |
| $As_2O_3$ | 10 | −1.05 | −1.08 | −1.14 | Hg | 40 |
| $As_2O_3$ | 10 | −1.05 | −1.14 | −1.35 | Hg | 50 |
| SbOCl | 10 | −1.04 | −1.04 | −1.04 | Hg | 10 |
| SbOCl | 10 | −1.04 | −1.04 | −1.06 | Hg | 20 |
| SbOCl | 10 | −1.05 | −1.06 | −1.08 | Hg | 30 |
| SbOCl | 10 | −1.04 | −1.09 | −1.21 | Hg | 40 |
| SbOCl | 10 | −1.04 | −1.16 | −1.35 | Hg | 50 |
| BiOCl | 10 | −1.04 | −1.04 | −1.04 | Hg | 10 |
| BiOCl | 10 | −1.04 | −1.07 | −1.11 | Hg | 20 |
| BiOCl | 10 | −1.05 | −1.13 | −1.18 | Hg | 30 |
| BiOCl | 10 | −1.05 | −1.17 | −1.48 | Hg | 50 |

EXAMPLE 7

A series of samples, similar to those of Example 1, were activated following the same procedure with the only difference that the types of dopant were selected among the elements of the groups VB, VIA and VIB of the Periodic Table, added to the paint in the form of suitable compounds.

The dopant concentration in the paint was 100 ppm, as metal. The activated samples were utilized as cathodes under the same operating conditions of Example 1. The cathodic potentials, detected in the same way, are reported in Table 7, as a function of time.

TABLE 7

Cathodic Potentials as a function of electrolysis time

| Type of dopant added to the paint | | Cathodic potential V (HgO/Hg) | | | Impurity contained in NaOH | |
|---|---|---|---|---|---|---|
| Salt | ppm (as metal) | initial | 1 day | 10 days | type | ppm (as metal) |
| nil | — | −1.01 | −1.01 | −1.01 | — | — |
| nil | — | −1.01 | −1.02 | −1.03 | Fe | 50 |
| nil | — | −1.01 | −1.02 | −1.18 | Hg | 10 |
| $SeO_2$ | 100 | −1.01 | −1.01 | −1.01 | Fe | 50 |
| $TeO_2$ | 100 | −1.01 | −1.02 | −1.02 | Fe | 50 |
| $MoO_3$ | 100 | −1.04 | −1.04 | −1.04 | Fe | 50 |
| $WO_3$ | 100 | −1.04 | −1.04 | −1.04 | Fe | 50 |
| $VOCl_2$ | 100 | −1.03 | −1.05 | −1.14 | Hg | 10 |
| $SeO_2$ | 100 | −1.01 | −1.02 | −1.05 | Hg | 10 |
| $TeO_2$ | 100 | −1.01 | −1.03 | −1.12 | Hg | 10 |
| $MoO_2$ | 100 | −1.01 | −1.02 | −1.07 | Hg | 10 |
| $WO_3$ | 100 | −1.02 | −1.02 | −1.09 | Hg | 10 |

EXAMPLE 8

A series of nickel expanded sheet samples similar to those of Examples 1 were activated as illustrated in Example 1, the only difference being represented by the fact that the dopants are added to the paint two by two, in the form of suitable compounds.

The selected dopants were molybdenum, selenium, cadmium, antimonium and bismuth.

The activated samples were tested as cathodes under the same operating conditions illustrated in Example 1. The cathodic potentials, detected in the same way, are reported in Table 8, as a function of time.

TABLE 8

Cathodic Potentials as a function of electrolysis time

| Type of dopant added to the paint | | Cathodic Potential V (HgO/Hg) | | | Impurity contained in NaOH | |
|---|---|---|---|---|---|---|
| Salt | ppm (as metal) | initial | 1 day | 10 days | type | ppm (as metal) |
| nil | — | −1.01 | −1.01 | −1.01 | — | — |
| nil | — | −1.01 | −1.02 | −1.03 | Fe | 50 |
| nil | — | −1.01 | −1.02 | −1.18 | Hg | 10 |
| Sb2O3 | 100 | | | | | |
| & | | −1.02 | −1.02 | −1.02 | Fe | 50 |
| $MoO_3$ | 100 | | | | | |
| $Cd(NO_3)_2$ | 100 | | | | | |
| & | | −1.01 | −1.01 | −1.01 | Fe | 50 |
| $MoO_3$ | 100 | | | | | |
| BiOCl | 100 | | | | | |
| & | | −1.01 | −1.02 | −1.04 | Hg | 10 |
| $SeO_2$ | 100 | | | | | |
| SbOCl | 100 | | | | | |
| & | | −1.02 | −1.02 | −1.05 | Hg | 10 |
| $MoO_3$ | 100 | | | | | |

EXAMPLE 9

Several mesh samples of 25 mesh nickel wire having a wire diameter of 0.1 mm, were prepared as illustrated in Example 2.

Salts of the elements belonging to the groups IB and VIII were added to the paiint in a quantity of 0.1 ppm as metal.

After drying at 60° C. for about 10 minutes, the sample was heated in an oven in the presence of air at 480° C. for 10 minutes and then allowed to cool down to room temperature.

The thickness of the electrocatalytic ceramic oxide coating (substantially solid solution of $TiO_2$ and $RuO_2$) was about 2 micrometers and the quantity of ruthenium was about 4 grams per square meter of coated surface.

The electrodes thus prepared have been tested as cathodes under the same conditions illustrated in Example 1. The cathodic potentials are reported in Table 9 as a function of time.

TABLE 9

Cathodic Potentials as a function of electrolysis time

| Type of dopant added to the paint | | Cathodic Potential V (HgO/Hg) | | | Impurity contained in NaOH | |
|---|---|---|---|---|---|---|
| Salt | ppm (as metal) | initial | 1 day | 10 days | type | ppm (as metal) |
| nil | — | −1.04 | −1.04 | −1.04 | — | — |
| nil | — | −1.04 | −1.05 | −1.25 | Hg | 10 |
| $PtCl_4$ | 0.1 | −1.04 | −1.04 | −1.07 | Hg | 10 |
| $PdCl_2$ | 0.1 | −1.04 | −1.04 | −1.08 | Hg | 10 |
| $CuCl_2$ | 0.1 | −1.04 | −1.04 | −1.06 | Hg | 10 |
| $Ag(NH_3)_2Cl$ | 0.1 | −1.05 | −1.05 | −1.07 | Hg | 10 |
| $AuCl_3$ | 0.1 | −1.05 | −1.05 | −1.07 | Hg | 10 |

EXAMPLE 10

Several samples of nickel wire 25 mesh screen, having a diameter of 0.1 mm, were prepared as illustrated in Example 2.

The quantity and type of doping elements added to the paint utilized for the thermal activation are reported in the following Table 10.

The samples were then tested as cathodes under the same operating conditions described in Example 9.

The cathodic potentials are reported in Table 10 as a function of the electrolysis time.

TABLE 10

Cathodic Potentials as a function of electrolysis time

| Type of dopant added to the paint | | Cathodic Potential V (HgO/Hg) | | | Impurity contained in NaOH | |
|---|---|---|---|---|---|---|
| compound | ppm (as metal) | initial | 1 day | 10 days | type | ppm (as metal) |
| nil | — | −1.04 | −1.04 | −1.04 | — | — |
| nil | — | −1.04 | −1.05 | −1.06 | Fe | 50 |
| nil | — | −1.04 | −1.05 | −1.25 | Hg | 10 |
| $SeO_2$ | 100 | −1.05 | −1.05 | −1.05 | Fe | 50 |
| $TeO_2$ | 100 | −1.05 | −1.05 | −1.05 | Fe | 50 |
| $MoO_3$ | 100 | −1.05 | −1.05 | −1.05 | Fe | 50 |

TABLE 10-continued

Cathodic Potentials as a function of electrolysis time

| Type of dopant added to the paint | | Cathodic Potential V (HgO/Hg) | | | Impurity contained in NaOH | |
|---|---|---|---|---|---|---|
| compound | ppm (as metal) | initial | 1 day | 10 days | type | ppm (as metal) |
| $WO_3$ | 100 | −1.04 | −1.04 | −1.04 | Fe | 50 |
| $VOCl_2$ | 100 | −1.05 | −1.09 | −1.15 | Hg | 10 |
| $SeO_2$ | 100 | −1.05 | −1.07 | −1.09 | Hg | 10 |
| $TeO_2$ | 100 | −1.05 | −1.09 | −1.11 | Hg | 10 |
| $MoO_3$ | 100 | −1.04 | −1.07 | −1.08 | Hg | 10 |
| $WO_3$ | 100 | −1.04 | −1.06 | −1.12 | Hg | 10 |

We claim:

1. In a cathode for use in electrolytic cells for the electrolysis of alkali metal halide which comprises an external electrocatalytic coating of a ceramic material selected from the group of oxides and mixed oxides of metals selected from the group of platinum group metals, titanium tantalum, zirconium, niobium, hafnium, nickel, cobalt, tin, manganese, and yttrium; wherein said coating of ceramic material is obtained by the thermal decomposition of a solution or dispersion of precursor compounds, the improvement being in order to make said cathode resistant to the deactivation of the electrocatalytic activity due to the action of iron, mercury, and heavy metal tracks in the electrolyte, as a solution or dispersion further contains at least a compound of elements selected from the group consisting of arsenic, and selenium.

2. The cathode of claim 1 wherein said element is arsenic.

3. A method for electrolyzing an alkali metal chloride solution which comprises feeding an alkali metal chloride solution to an electrolytic cell that comprises an anode and the cathode of claim 1 separated from said anode by an ion exchange membrane that is substantially impermeable to electrolyte flow.

4. The method of claim 3 wherein said element is arsenic.

5. The method of claim 3 wherein said element is selenium.

6. Electrolytic cell for the electrolysis of alkali metal halide which comprises an anode and the cathode of claim 1, separated from said anode by an ion exchange membrane that is substantially impermeable to electrolyte flow.

7. The cathode of claim 1 wherein said element is selenium.

* * * * *